US009192821B2

(12) United States Patent
Smith

(10) Patent No.: US 9,192,821 B2
(45) Date of Patent: Nov. 24, 2015

(54) LIGHT TRANSMISSION SYSTEM FOR A LIGHT EMITTING GAME BALL

(76) Inventor: Carson K. Smith, Oregon City, OR (US)

( * ) Notice: Subject to any disclaimer, the term of this patent is extended or adjusted under 35 U.S.C. 154(b) by 104 days.

(21) Appl. No.: 13/495,855

(22) Filed: Jun. 13, 2012

(65) Prior Publication Data

US 2013/0337948 A1 Dec. 19, 2013

(51) Int. Cl.
*A63B 43/06* (2006.01)
*A63B 43/00* (2006.01)

(52) U.S. Cl.
CPC ..... *A63B 43/06* (2013.01); *A63B 43/002* (2013.01); *A63B 2243/007* (2013.01)

(58) Field of Classification Search
CPC ..... A63B 37/00; A63B 43/06; A63B 43/04; A63B 43/002; A63B 2243/007; A63B 37/0001
See application file for complete search history.

(56) References Cited

U.S. PATENT DOCUMENTS

| | | | | | |
|---|---|---|---|---|---|
| 2,003,957 | A | * | 6/1935 | Salisbury | 446/409 |
| 2,020,484 | A | * | 11/1935 | Turner | 473/570 |
| 3,804,411 | A | | 4/1974 | Hendry | |
| 4,002,893 | A | * | 1/1977 | Newcomb et al. | 473/570 |
| 4,133,528 | A | * | 1/1979 | Koblick | 473/570 |
| 4,695,055 | A | | 9/1987 | Newcomb et al. | |
| 4,846,475 | A | * | 7/1989 | Newcomb et al. | 473/570 |
| 4,874,169 | A | | 10/1989 | Litchfield | |
| 4,963,117 | A | | 10/1990 | Gualdoni | |
| 5,054,778 | A | * | 10/1991 | Maleyko | 473/570 |
| 5,066,012 | A | * | 11/1991 | Stark | 473/570 |
| 5,186,458 | A | | 2/1993 | Redondo | |
| 5,253,866 | A | | 10/1993 | Moorman et al. | |
| 5,564,702 | A | * | 10/1996 | Meffert | 273/153 R |
| 5,683,316 | A | * | 11/1997 | Campbell | 473/570 |
| 5,762,573 | A | | 6/1998 | Kennedy et al. | |
| 6,059,676 | A | | 5/2000 | Seymour et al. | |
| 6,547,420 | B2 | | 4/2003 | Li | |
| 6,575,855 | B1 | * | 6/2003 | Buzak et al. | 473/569 |
| 6,726,580 | B2 | * | 4/2004 | Peterson | 473/570 |
| 7,261,432 | B1 | * | 8/2007 | Habitz | 362/196 |
| 7,288,037 | B2 | * | 10/2007 | Myers | 473/613 |
| 2003/0008727 | A1 | * | 1/2003 | Miller | 473/351 |
| 2003/0199343 | A1 | | 10/2003 | Ilcisin et al. | |
| 2007/0281811 | A1 | * | 12/2007 | Wang | 473/570 |
| 2007/0289553 | A1 | * | 12/2007 | Jager | 119/710 |
| 2008/0039250 | A1 | * | 2/2008 | Martino | 473/613 |
| 2011/0185980 | A1 | * | 8/2011 | Chefetz et al. | 119/709 |

OTHER PUBLICATIONS

Smith, U.S. Appl. No. 13/304,205, filed Nov. 23, 2011.
Smith, U.S. Appl. No. 12/011,803, filed Jan. 29, 2008.
Smith, U.S. Appl. No. 12/573,050, filed Oct. 2, 2009.

* cited by examiner

*Primary Examiner* — Steven Wong
(74) *Attorney, Agent, or Firm* — Portland Intellectual Property, LLC

(57) ABSTRACT

A light transmission system for a light emitting game ball provides light passageways extending outwardly from an elongate cavity within the game ball adapted for containing an elongate light source. The shape of each passageway at the exterior surface of the ball is substantially different from the shape of the corresponding joining aperture formed by the intersection of the passageway and the cavity.

36 Claims, 4 Drawing Sheets

LIGHT TRANSMISSION SYSTEM FOR A LIGHT EMITTING GAME BALL

FIELD OF THE INVENTION

The present invention relates to a system for transmitting light from a game ball, particularly a game ball that provides illumination by way of an elongate light emitting device such as a light stick.

BACKGROUND

It is becoming increasingly popular to provide for light displays in various objects, including game balls. For example, U.S. Pat. No. 6,726,580 discloses an American football style game ball having provision for inserting a "light stick" therein. Light sticks, also referred to as glow sticks, are well known disposable sources of softly glowing light. A light stick is formed of a translucent tube carrying two chemicals that are separated by a barrier. The user of a light stick bends or snaps it to break the barrier so that the chemicals mix and chemically react with one another to produce light for a limited period of time.

The football of the '580 patent has an interior bore formed of a translucent or transparent plastic tube. Each end of the tube has screw threads for receiving a removable cap to provide access to the tube for inserting the light stick after it has been activated, and to retain the light stick in the tube. The remainder of the football is formed of a translucent or transparent material to allow the light produced by the light stick, passing through the tube, to pass through the remainder of the football so that it can be seen by those watching or using the football.

The requirement for a transparent or translucent material for forming the game ball is a significant disadvantage, both because the choice of materials is quite limited and because it is not generally an advantage to be able to see through a game ball. To the contrary, game balls are easier to see and catch when they are opaque.

A response to this problem is found in U.S. Pat. No. 5,683,316, which discloses another American style football incorporating a number of light sticks. The light sticks are inserted into respective flexible housings, corresponding to the tube in the '580 patent, attached to the exterior surface of the ball.

Though not very practical, battery powered incandescent light sources have also been known for use inside game balls. An example is the "luminous ball" disclosed in U.S. Pat. No. 2,020,484. The game ball in the '484 patent is spherical and, instead of utilizing a translucent or transparent material for transmitting light from the light source through the ball, the ball incorporates a plurality of "passageways" or tubes extending from a cavity in the center of the ball, in the center of which the light source is disposed, through the shell or casing of the ball. The cavity is considerably larger than the light source itself, apparently to provide space for a spring suspension system for supporting the light source in a manner adapted to attenuate shock.

It is an objective of the present invention to provide for improvements in the manner by which light is transmitted from a light emitting game ball.

SUMMARY

A light transmission system for a light emitting game ball is disclosed herein. The game ball has a substantially opaque game ball body and an elongate cavity and a plurality of elongate passageways therein. Each passageway extends from a distinct opening defined on the exterior surface of the body to a cavity joining aperture defined at the cavity. The shape of the opening is substantially different from the shape of the cavity joining aperture.

Preferably, the elongate cavity defines an elongate cavity axis, wherein any given joining aperture has dimensions ($A_{JA}$, $B_{JA}$), where $A_{JA}$ is the maximum size of the given joining aperture measured parallel to the cavity axis, and $B_{JA}$ is the maximum size of the given joining aperture measured perpendicular to the cavity axis. Preferably, the dimension $A_{JA}$ is substantially larger than the dimension $B_{JA}$.

The elongate passageways define corresponding elongate passageway axes. The passageways extend from corresponding openings thereof defined on the exterior surface of the body to the cavity. Preferably, each passageway axis strikes a corresponding angle θ relative to the cavity axis, and each passageway defines an unobstructed path for light to travel from the cavity through the passageways and out the openings to points outside the game ball body.

Any given passageway has a series of dimensions ($A_n$, $B_n$) measured in a respective series of cross-sectional planes $P_n$ taken perpendicular to the passageway axis for the given passageway, where $A_n$ is the maximum size of the given passageway measured parallel to the cavity axis, and $B_n$ is the maximum size of the given passageway measured perpendicular to the cavity axis. At the openings, the cross-sectional plane $P_n$ is $P_0$ and the corresponding dimensions are ($A_0$, $B_0$).

The passageways join the cavity to define at the cavity respective joining apertures. Any given joining aperture has dimensions ($A_{JA}$, $B_{JA}$), where $A_{JA}$ is the maximum size of the given joining aperture measured parallel to the cavity axis, and $B_{JA}$ is the maximum size of the given joining aperture measured perpendicular to the cavity axis.

Preferably, the value of $A_{JA}$ corresponding to any given passageway is no less than 80%, and more preferably no less than 90%, of the value $A_0/(\cos\theta)$ for the given passageway, and the value of $B_{JA}$ corresponding to any given passageway is preferably no more than 70%, and more preferably no more than 60%, of the value $B_0$ for the given passageway.

Preferably, the openings are circular, and preferably, they are all the same size.

Preferably, any given passageway defines at least two distinct regions $R_1$ and $R_2$ thereof. The region $R_1$ for the given passageway begins at the plane $P_0$ for the given passageway and extends toward the cavity a distance $L_1$, and the region $R_2$ for the given passageway extends a distance $L_2$ and ends at the cavity. Over the region $R_1$ of the given passageway, the dimensions $B_n$ for the given passageway preferably do not decrease to less than 90% of the value of $B_0$ for the given passageway, and over the region $R_2$ of the given passageway, the dimensions $B_n$ for the given passageway preferably decrease to an amount at the joining aperture for the given passageway that is less than 70% of the value of $B_0$ for the given passageway. Preferably, the distance $L_1$ is at least 1".

Preferably, there are at least two passageways at different angles θ, and the dimensions $A_0$ are the same for each.

Preferably, there are at least two passageways at the same angle θ, the passageway axes thereof being collinear.

Also disclosed is a method for removing a light source from a game ball having an elongate cavity therein, the cavity having an elongate axis, the cavity extending to the exterior surface of the game ball and thereby defining an insertion/removal aperture therein, the light source being installed in the cavity.

The method includes applying a compressive force to the game ball so as to compress the game ball along the elongate axis with the result that a portion of the light source that did not previously extend through the insertion/removal aperture now extends through the insertion/removal aperture, grasping the portion, and pulling on the portion and thereby removing the light source from the game ball.

Preferably, after the step of pulling, the method includes releasing the compressive force, thereby allowing the game ball to decompress.

Preferably, the step of applying results in expanding the insertion/removal aperture by means of the portion extending therethrough.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

DETAILED DESCRIPTION OF PREFERRED EMBODIMENTS

The present invention represents a further development of inventions described in the inventor's prior patent applications, U.S. patent application publication No's. 2009/0191990, and 2010/0035710, the specifications of both being hereby incorporated by reference in their entireties (the "prior applications").

A preferred application of the invention is in an American style football containing one or more light sticks in the interior thereof. Disposable light sticks are commonly available, inexpensive and easy to use, and are currently the light source of choice for use in game balls, particularly American style footballs in which their elongate shape is particularly well suited.

Figure 1:
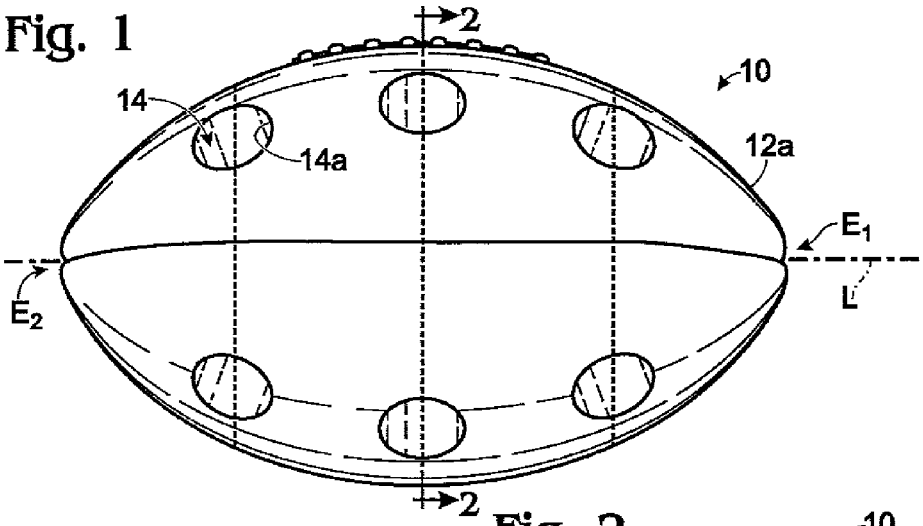
FIG. 1 is an elevation view of a game ball according to the present invention.

FIG. 1 shows a preferred game ball 10 according to the invention, which is configured as an American style football. The prior applications described a similarly configured game ball formed of a NERF™ material, which is a highly foamed and therefore very low density material suitable for playing spatially limited indoor ball games without posing a significant risk of displacement of or damage to lightweight household items that may be struck by the ball.

By contrast, the game ball 10 is preferably formed of a denser, less aerated plastic material, so that while remaining highly compliant, it is heavier and more fun to handle and throw. Preferably, it is formed of foamed polyurethane, though other plastic materials could be used. Preferably the material as formed has a density of about 150-210 kg/m$^3$, and most preferably about 180 kg/m$^3$.

The ball 10 has an exterior surface 12*a*, and there is an elongate ball axis "L" about which the surface 12*a* is an oval of revolution. The ball axis "L" defines two ends "E," namely, "$E_1$" and "$E_2$" of the ball 10. It may be noted that if the ball were spherical, the ball axis L would be arbitrary, but such an axis could still be defined.

Figure 2:
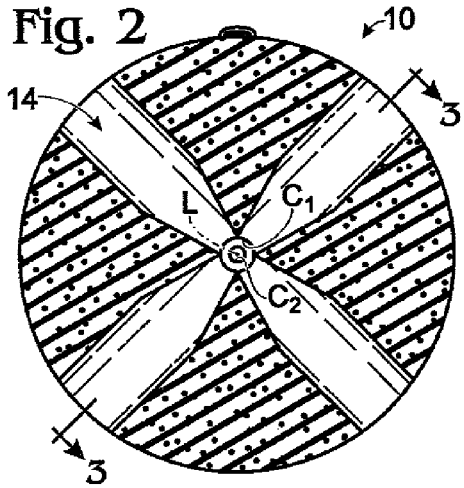
FIG. 2 is a cross-section of the game ball of FIG. 1, taken along a line 2-2 thereof.

Referring to FIG. 2, the ball 10 has a tubular central cavity "C," including a cavity portion "$C_1$" having a tubular axis that is coincident with the ball axis L. Due to this equivalence, the ball axis will hereinafter be referred to as the "cavity axis." The diameter "$D_1$" of the cavity portion $C_1$ is sized to allow the cavity portion $C_1$ to receive and retain therein a light stick (not shown) having substantially the same length and diameter.

Figure 3:
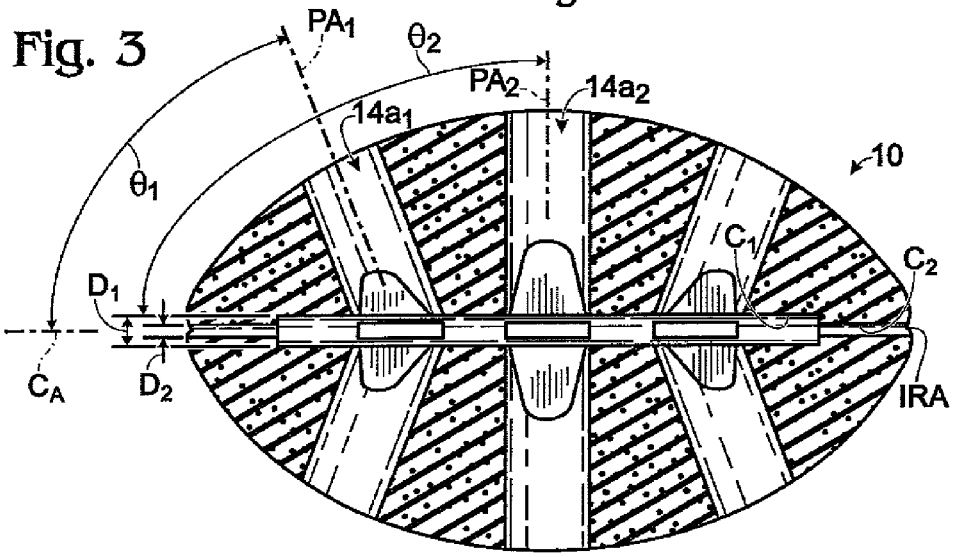
FIG. 3 is a cross-section of the game ball of FIG. 2, taken along a line 3-3 thereof.

Preferably, the ball 10 is integrally formed, and preferably the length of the light stick is less than or equal to the corresponding length of the cavity portion $C_1$. So, an additional insertion removal portion $C_2$ of the central cavity C extends from the cavity portion $C_1$ to the exterior surface 12*a* of the ball to define an insertion/removal aperture IRA thereon, to provide a means for installing a light stick in or removing a light stick from the cavity portion $C_1$. There may be two such insertion/removal portions as shown in FIG. 3, one extending to each end of the ball so as to define two insertion/removal apertures.

The diameter "$D_2$" (or more generally, a selected width dimension) of the insertion/removal portion $C_2$ is preferably smaller than the diameter (or selected width dimension) of the light stick, and therefore smaller than the diameter $D_1$ (or selected width dimension) of the cavity portion $C_1$. This is so the insertion/removal portion $C_2$ also functions to retain the light stick in the cavity portion $C_1$, by closing it off. That is, the light stick cannot be passed into or out of the cavity portion $C_1$ without deforming the body 12 in the vicinity of the insertion/removal portion $C_2$ because the portion $C_2$ does not otherwise provide a sufficiently large opening. For a light stick 18 that is already installed in the cavity portion $C_1$, the user overcomes the resistance provided by this relatively small diameter portion $C_2$ for the purpose of removing the light stick from the cavity portion by manually compressing the ball along the axis L, i.e., by pushing the ends E toward one another, sufficiently so that an end 19 of the light stick is forced to protrude from at least one of them where it can be grasped for removal.

Figure 5:
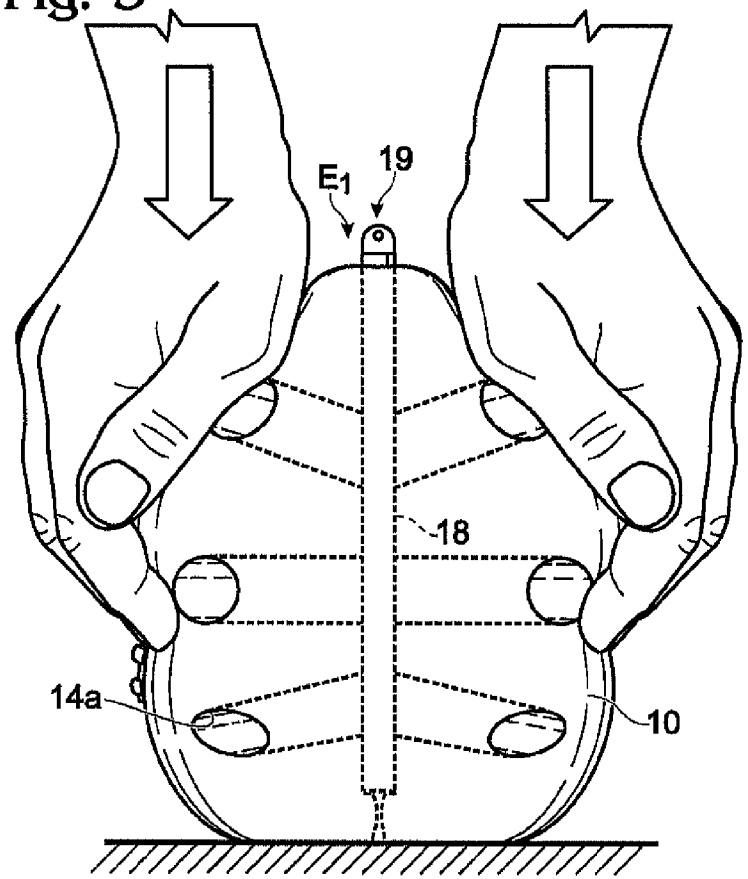
FIG. 5 is an elevation view of the game ball of FIG. 4, showing the user compressing the ball with the result that an end of a light stick therein is caused to protrude from the ball.
Figure 4:
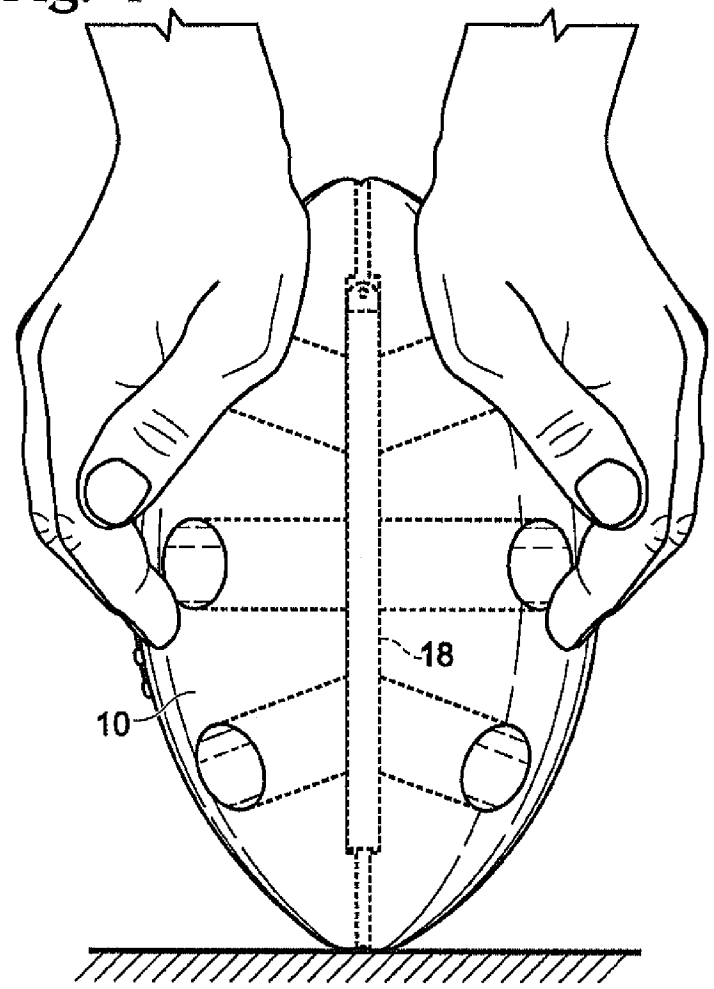
FIG. 4 is an elevation view of the game ball of FIG. 1, illustrating a user gripping the ball in preparation for either installing a light stick therein or removing a light stick therefrom.

FIGS. 4 and 5 provide an illustration of this action. After compressing the ball by advancing the hands in the direction of the open arrows (FIG. 5), an end 19 of the light stick 18 protrudes from the end $E_1$ which can be grasped for removing the light stick from the ball. Thereafter, the user releases the compressive force by vertically retracting or removing his or her hands, which allows the body of the ball to spring back to its original length (measured along the axis L).

FIGS. 5 and 4 also illustrate a process that may be used for installing the light stick 18. First, the ball is compressed and the light stick inserted with the result being as shown in FIG. 5, and then the ball is released as shown in FIG. 4, so that it springs back to its original length and engulfs the light stick within the cavity portion $C_1$. However, a user may find it preferable to install the light stick merely by pushing it into the cavity with the end of a finger, without compressing the ball.

Compressing the ball is made easier for the user by the provision of passageways 14 as will be described below. These passageways weaken the ball in compression along the axis L (note the distortion of the passageway 14*a*). Compressing the ball is easily accomplished by the use of two hands as shown, with the end "E" of the ball that is opposite the end through which the light stick is to be either inserted or removed resting on the ground, so that the user can lean on the ball with his or her body weight.

While it is easiest to compress the ball with the use of two hands as shown, another person will generally be required to insert or remove the light stick. Often, when playing with the ball, there will be more than one person available so that this will not be a problem. If not, though it requires greater strength, the compressing action can be performed with one hand, with the thumb and fingers partially encircling the ball at a convenient latitude between the ball's equator and north pole, leaving the other hand free to insert or remove the light stick.

Returning to FIG. 1, the ball 10 includes a plurality of the passageways 14. Six such passageways are visible, and an identical six are provided in the preferred embodiment with mirror image symmetry about the plane of the Figure. With additional reference to FIGS. 2 and 3, each passageway extends through openings "OP" at the exterior surface 12*a* of the ball, through the material of which the ball is formed, and into the cavity portion $C_1$ of the central cavity C. The passageways provide unobstructed paths for light to travel from the cavity, through the passageways, and out the openings to points outside the body of the game ball, where the light can be seen and enjoyed by users of the ball, or by spectators of the game in which the ball is being used.

With particular reference to FIG. 3, each passageway 14 is elongate and defines an elongate central passageway axis "PA," and each passageway extends parallel to its passageway axis. Each passageway axis makes an angle θ with the cavity axis "CA" of the central cavity C. For example, the passageway 14$a_1$ has a passageway axis $PA_1$ at an angle $\theta_1$=(about) 60 degrees from the axis CA, and the passageway 14$a_2$ has a passageway axis $PA_2$ at an angle $\theta_2$=90 degrees from the axis CA.

FIG. 5 shows a general passageway 14. There is a series of cross-sectional planes $P_n$ that can be drawn perpendicular to the passageway axis PA. In an outermost one of these planes, $P_0$, the passageway defines an opening OP on the exterior surface 12*a* of the ball 10.

In the preferred embodiment of the ball, the passageway is cylindrical near the opening OP, so that it defines a circle in all planes $P_n$ that are near the opening OP. It should be understood that a cylindrical passageway will generally not define a perfectly circular opening on the exterior surface of the ball, i.e., it will generally not define a perfect circle in the plane $P_0$, unless the ball is spherical. However, even in an American style football, which is far from being spherical, the opening OP appears substantially circular to the eye. So for practical purposes, it is not generally important to make a distinction between the cross-section of the passageway in the plane $P_0$ and the cross-section in planes $P_n$ deeper within the interior of the ball, and such a distinction will not be made hereafter unless expressly indicated.

In general, the passageway is not cylindrical, at least not along its entire length, and it can be defined generally by two orthogonal dimensions ($A_n$, $B_n$) measured in the respective cross-sectional planes $P_n$. The dimension $A_n$ is the maximum size of the passageway measured in the plane $P_n$ in a direction parallel to the cavity axis (the "A dimension" as defined for the passageway), and the dimension $B_n$ is the maximum size of the passageway measured in the plane $P_n$ in a direction perpendicular to the cavity axis (the "B dimension" as defined for the passageway).

At the opening OP, the cross-sectional plane is $P_0$, at which the A and B dimensions are $A_0$ and $B_0$.

Each passageway 14 is also open where it joins the central cavity, at joining apertures JA. According to the invention, for any given passageway, the shape of the opening is substantially different from the shape of the joining aperture. For example, where the shape of the opening is substantially circular, the shape of the joining aperture is rectangular or approximately rectangular.

Each joining aperture defines length and width dimensions ($A_{JA}$, $B_{JA}$) of the passageway, where $A_{JA}$ is the maximum size of the joining aperture measured parallel to the cavity axis (the "A dimension" as defined for the joining aperture), and $B_{JA}$ is the maximum size of the joining aperture measured perpendicular to the cavity axis (the "B dimension" as defined for the joining aperture). The A dimension $A_{JA}$ can be seen in FIG. 5. Preferably, the dimension $A_{JA}$ is substantially greater than the dimension $B_{JA}$; particularly, the dimension $A_{JA}$ is preferably at least 30% greater than the dimension $B_{JA}$, more preferably it is at least 50% greater, and more preferably still it is at least 100% greater.

Figure 6:
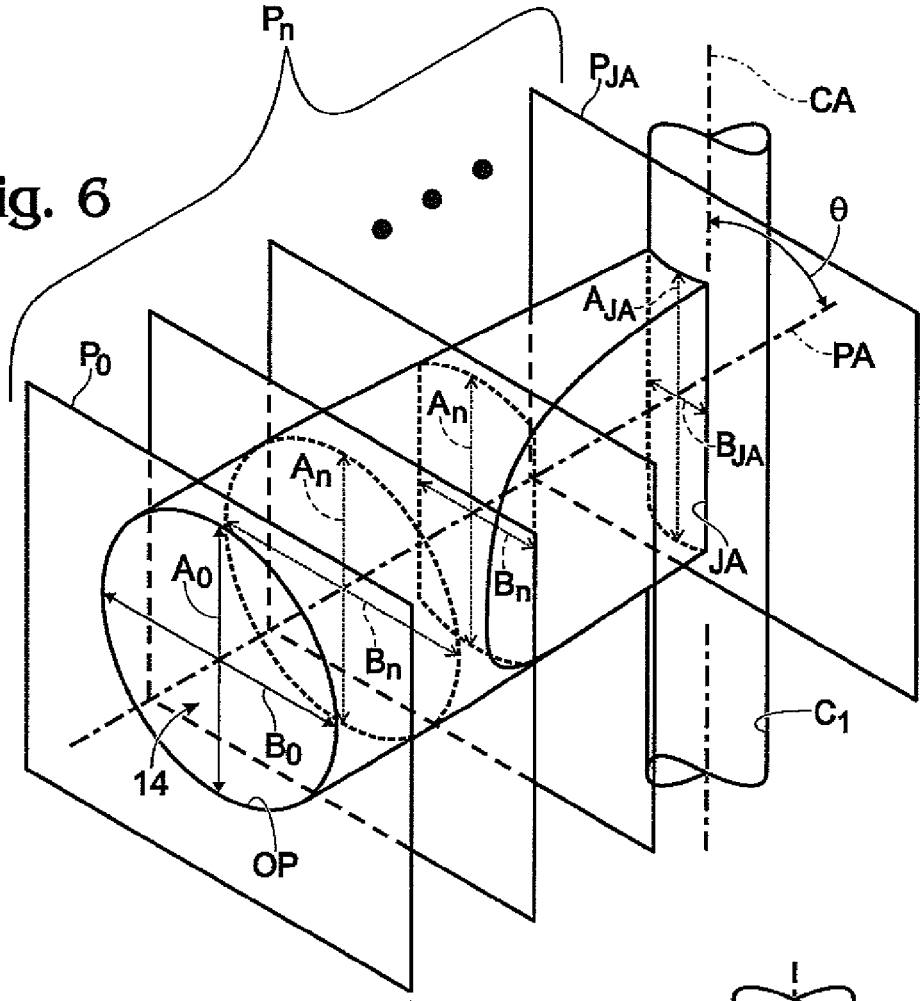
FIG. 6 is an isometric view of a passageway according to the invention, showing reference planes and selected dimensions.

FIG. 6 shows the passageway 14 looking at the opening OP, down the axis PA, into the joining aperture JA. This reveals the B dimension $B_{JA}$, which cannot be seen in FIG. 5.

According to the invention, $A_{JA}$ is ideally the projection of $A_0$ onto the cavity axis CA, i.e., $A_{JA}=A_0/(\cos\theta)$, or it may be greater than this amount, to maximize the amount of light gathered from the light stick. However, as a practical range, $A_{JA}$ should be greater than 80% of the value $A_0/(\cos\theta)$, more preferably 90% of this value, more preferably still at least 95% of this value, and most preferably at least 99% of this value. Preferably, if $A_{JA}$ is greater than $A_0/(\cos\theta)$, it is no more than about 20% greater.

Also according to the invention, independent of the value of $A_{JA}$, $B_{JA}$ is preferably less than 70% of $B_0$, more preferably it is less than 60% of this value, and most preferably it is between 45-55% of this value, to provide for what the inventor has determined to be an unexpectedly desirable enhancement to the structural integrity of the body in the vicinity of the cavity. More generally, the present inventor has recognized that it is important for transmitting light to maintain the A dimension of the opening all the way to the joining aperture, but it is not important to maintain the B dimension, which can be decreased to provide desirable structural integrity.

Figure 7:
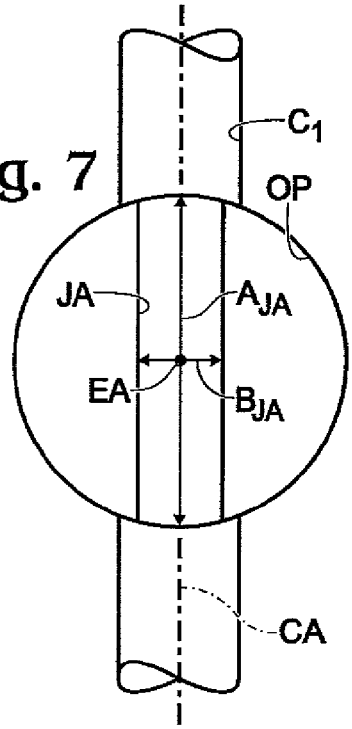
FIG. 7 is a view of the passageway of FIG. 6 looking down a central axis thereof.
Figure 8:
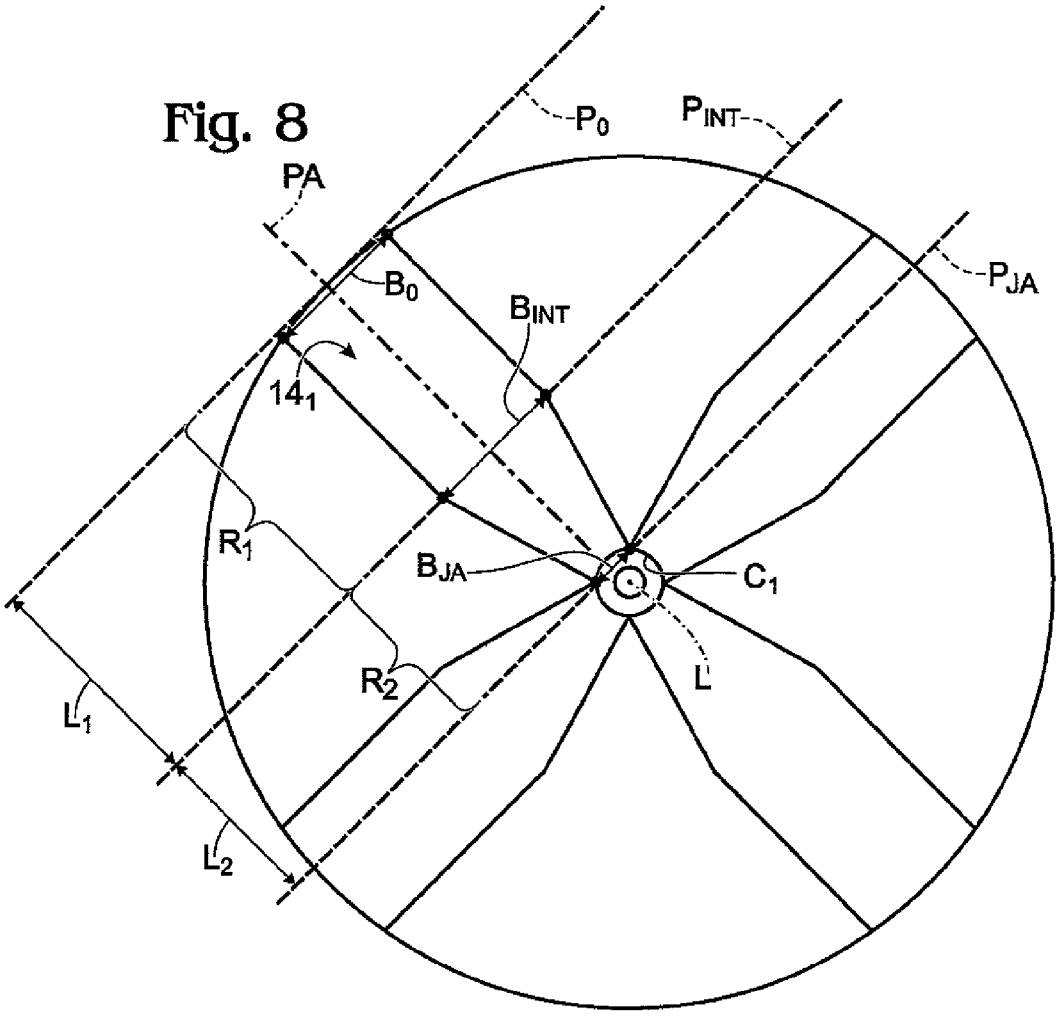
FIG. 8 is a schematized view of passageways according to the invention, from the vantage point of FIG. 2, showing reference planes and selected dimensions.
Figure 9:
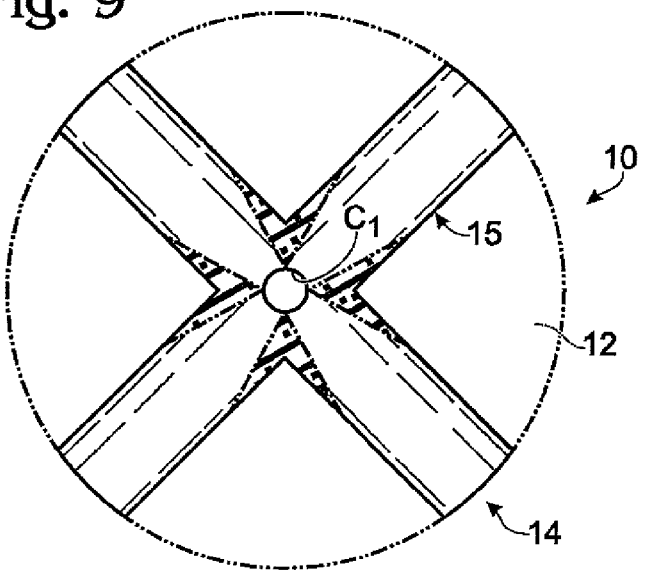
FIG. 9 is a schematized view of the passageways of FIG. 8, showing, by comparison with hypothetical passageways, to illustrate an amount of material that is desirably retained according to the invention.

FIG. 3 shows a cross-section of the ball 10 in which it is apparent that the A dimension of the passageway is maintained all the way to the joining aperture, whereas by comparison, FIG. 7 shows a cross-section in which it is apparent that the B dimension of the passageway is decreased near the joining aperture along the direction perpendicular to the CA direction. FIG. 8 shows material (cross-hatched) that remains to provide structural integrity in the ball, material which would not be available for this purpose if the passageways remained of substantially constant cross-section as for the hypothetical passageways indicated by the reference designator 15, i.e., if the dimension $B_{JA}$ were not decreased relative to $B_0$ as shown in FIG. 5, and as shown in FIG. 7.

The aforedescribed geometry could be provided by a constant A dimension and a uniform, linearly decreasing taper of the B dimension from the opening OP to the joining aperture JA. But preferably the passageway differs from this configuration in both respects. Preferably, the ball 10 is molded in one piece by the use of removable tooling bits to define the passageways, central cavity, and insertion/removal aperture(s) as described. In that case, it is advantageous to provide a slight draft or taper of the passageway in the A dimension, e.g., 5%, to facilitate withdrawal of the tooling bits from the molded part.

Referring to FIG. 8, it is preferable to provide two distinct and consecutive regions $R_1$ and $R_2$ which differ in the rate of decrease of the B dimension. The region $R_1$ begins at the plane $P_0$ and ends at an interior plane $P_{INT}$ which is spaced from the plane $P_0$ by a depth "$L_1$." Over the region $R_1$, the B dimension of the passageway changes relatively slowly if it changes at all; particularly, it preferably changes linearly over this region no more than about 10% from its value at $P_0$ to its value at $P_{INT}$. Referring to FIG. 7, this change would be represented by a difference of no more than 10% in the dimensions "$B_0$" and "$B_{INT}$." Such a difference could, for example, be due to the same draft indicated above for the A dimension.

The region $R_2$ preferably begins where the region $R_1$ leaves off, i.e., at the plane $P_{INT}$, and it ends at the joining aperture, represented by the plane $P_{JA}$ in FIG. 7. The region $R_2$ extends a distance "$L_2$." Over the region $R_2$ the B dimension changes faster than it changes, if it changes at all, over the region $R_1$. More particularly, the B dimension decreases, preferably linearly, with increasing proximity to the joining aperture, from its value at $P_{INT}$ to a final value at the joining aperture that is at least 50% less than its original value at the plane $P_0$.

Preferably $L_2$ is at least 1", and it is more preferably at least 1.5". When considered relative to $L_1$, $L_2$ is preferably less than $L_1$ but is at least 25% of $L_1$; more preferably, it is at least 50% of $L_1$; and more preferably still it is at least 75% of $L_1$. Though it is not preferred, $L_2$ may be greater than $L_1$, but it should not be any more than 50% greater.

The openings OP of the passageways 14 are preferably substantially circular, each having substantially the same size, suitable for receiving a single finger or thumb, to facilitate the user's manipulation and enjoyment of the ball in any orientation. The region $R_1$ ensures an adequate finger/thumb sized receptacle over a sufficient depth to facilitate gripping. For the gripping purpose, the diameter of each opening OP is preferably in the range of ⅞" to 1½", and is most preferably about 1⅛" (the football as shown in FIG. 1 being about 10" long and the Figure being drawn to scale).

While it was noted previously that the passageways are primarily provided to transmit light, they can serve a secondary purpose when aligned to form continuous paths from one side of the ball to the other. That is, the present inventor has discovered that two passageways, one extending from an opening on one side of the ball to the central cavity, and another extending from the central cavity to the opposite side of the ball, increase the distance that the ball can be thrown when the cavity is not holding a light stick. It is believed that this effect is due to the passage of air through the ball, and it is believed that the effect is enhanced when the passages are aligned such that light is able to pass in a straight line from the opening of one of the passageways to the opening of the other. When passageways are provided for this secondary purpose, it is not essential that they have any of the particular configurations or dimensional characteristics indicated above.

It is to be understood that, while a specific light transmission system for a light emitting game ball has been shown and described as preferred, other configurations could be utilized, in addition to those already mentioned, without departing from the principles of the invention. It may soon be the case that disposable or non-disposable LED ("Light Emitting Diode") light sources will be provided in elongate forms equivalent to light sticks, and thus could be used interchangeably therewith. Any other light emitting technology could also be used.

It is also not essential that the ball have an elongate shape, like an American style football. The ball could be spherical, or it could have any other desired shape.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A game ball, comprising a substantially opaque game ball body having an elongate cavity and a plurality of elongate passageways therein, each passageway extending from a distinct opening defined on the exterior surface of the body to a cavity joining aperture defined at the cavity, wherein the shape of the opening is substantially different from the shape of the cavity joining aperture, wherein the elongate cavity defines an elongate cavity axis, wherein any given joining aperture has dimensions ($A_{JA}$, $B_{JA}$), where $A_{JA}$ is the maximum size of the given joining aperture measured parallel to the cavity axis, and $B_{JA}$ is the maximum size of the given joining aperture measured perpendicular to the cavity axis, wherein the dimension $A_{JA}$ is substantially larger than the dimension $B_{JA}$.

2. The game ball of claim 1, wherein the elongate passageways define corresponding elongate passageway axes, each passageway axis striking a corresponding angle θ relative to the cavity axis, each passageway defining an unobstructed path for light to travel from the cavity through the passageways and out the openings to points outside the game ball body, any given passageway having a series of dimensions ($A_n$, $B_n$) measured in a respective series of cross-sectional planes $P_n$ taken perpendicular to the passageway axis for the given passageway, where $A_n$ is the maximum size of the given passageway measured parallel to the cavity axis, and $B_n$ is the maximum size of the given passageway measured perpendicular to the cavity axis, where, at the openings, the cross-sectional plane $P_n$ is $P_0$ and the corresponding dimensions are ($A_0$, $B_0$), where the value of $A_{JA}$ corresponding to any given passageway is no less than 80% of the value $A_0/(\cos\theta)$ for the given passageway, and where the value of $B_{JA}$ corresponding to any given passageway is no more than 70% of the value $B_0$ for the given passageway.

3. The game ball of claim 2, where the value of $A_{JA}$ corresponding to any given passageway is no less than 90% of the value $A_0/(\cos\theta)$ for the given passageway, and where the value of $B_{JA}$ corresponding to any given passageway is no more than 60% of the value $B_0$ for the given passageway.

4. The game ball of claim 3, including at least two passageways at different angles θ, and the dimensions $A_0$ are the same for each.

5. The game ball of claim 2, including at least two passageways at different angles θ, and the dimensions $A_0$ are the same for each.

6. The game ball of claim 5, including at least two passageways at the same angle θ, the passageway axes thereof being collinear.

7. The game ball of claim 4, including at least two passageways at the same angle θ, the passageway axes thereof being collinear.

8. The game ball of claim 3, including at least two passageways at the same angle θ, the passageway axes thereof being collinear.

9. The game ball of claim 2, including at least two passageways at the same angle θ, the passageway axes thereof being collinear.

10. The game ball of claim 9, where any given passageway defines at least two distinct regions $R_1$ and $R_2$ thereof along the corresponding passageway axis, where the region $R_1$ for the given passageway begins at the plane $P_0$ for the given passageway and extends toward the cavity a distance $L_1$, where the region $R_2$ for the given passageway extends a distance $L_2$ and ends at the cavity, where, over the region $R_1$ of the given passageway, the dimensions $B_n$ for the given passageway do not decrease to less than 90% of the value of $B_0$ for the given passageway, and where, over the region $R_2$ of the given passageway, the dimensions $B_n$ for the given passageway decrease to an amount at the joining aperture for the given passageway that is less than 70% of the value of $B_0$ for the given passageway, where the distance $L_1$ is at least 1".

11. The game ball of claim 8, where any given passageway defines at least two distinct regions $R_1$ and $R_2$ thereof along the corresponding passageway axis, where the region $R_1$ for the given passageway begins at the plane $P_0$ for the given passageway and extends toward the cavity a distance $L_1$, where the region $R_2$ for the given passageway extends a distance $L_2$ and ends at the cavity, where, over the region $R_1$ of the given passageway, the dimensions $B_n$ for the given passageway do not decrease to less than 90% of the value of $B_0$ for the given passageway, and where, over the region $R_2$ of the given passageway, the dimensions $B_n$ for the given passageway decrease to an amount at the joining aperture for the given passageway that is less than 70% of the value of $B_0$ for the given passageway, where the distance $L_1$ is at least 1".

12. The game ball of claim 7, where any given passageway defines at least two distinct regions $R_1$ and $R_2$ thereof along the corresponding passageway axis, where the region $R_1$ for the given passageway begins at the plane $P_0$ for the given passageway and extends toward the cavity a distance $L_1$, where the region $R_2$ for the given passageway extends a distance $L_2$ and ends at the cavity, where, over the region $R_1$ of the given passageway, the dimensions $B_n$ for the given passageway do not decrease to less than 90% of the value of $B_0$ for the given passageway, and where, over the region $R_2$ of the given passageway, the dimensions $B_n$ for the given passageway decrease to an amount at the joining aperture for the given passageway that is less than 70% of the value of $B_0$ for the given passageway, where the distance $L_1$ is at least 1".

13. The game ball of claim 6, where any given passageway defines at least two distinct regions $R_1$ and $R_2$ thereof along the corresponding passageway axis, where the region $R_1$ for the given passageway begins at the plane $P_0$ for the given passageway and extends toward the cavity a distance $L_1$, where the region $R_2$ for the given passageway extends a distance $L_2$ and ends at the cavity, where, over the region $R_1$ of the given passageway, the dimensions $B_n$ for the given passageway do not decrease to less than 90% of the value of $B_0$ for the given passageway, and where, over the region $R_2$ of the given passageway, the dimensions $B_n$ for the given passageway decrease to an amount at the joining aperture for the given passageway that is less than 70% of the value of $B_0$ for the given passageway, where the distance $L_1$ is at least 1".

14. The game ball of claim 5, where any given passageway defines at least two distinct regions $R_1$ and $R_2$ thereof along the corresponding passageway axis, where the region $R_1$ for the given passageway begins at the plane $P_0$ for the given passageway and extends toward the cavity a distance $L_1$, where the region $R_2$ for the given passageway extends a distance $L_2$ and ends at the cavity, where, over the region $R_1$ of the given passageway, the dimensions $B_n$ for the given passageway do not decrease to less than 90% of the value of $B_0$ for the given passageway, and where, over the region $R_2$ of the given passageway, the dimensions $B_n$ for the given passageway decrease to an amount at the joining aperture for the given passageway that is less than 70% of the value of $B_0$ for the given passageway, where the distance $L_1$ is at least 1".

15. The game ball of claim 4, where any given passageway defines at least two distinct regions $R_1$ and $R_2$ thereof along the corresponding passageway axis, where the region $R_1$ for the given passageway begins at the plane $P_0$ for the given passageway and extends toward the cavity a distance $L_1$, where the region $R_2$ for the given passageway extends a distance $L_2$ and ends at the cavity, where, over the region $R_1$ of the given passageway, the dimensions $B_n$ for the given passageway do not decrease to less than 90% of the value of $B_0$ for the given passageway, and where, over the region $R_2$ of the given passageway, the dimensions $B_n$ for the given passageway decrease to an amount at the joining aperture for the given passageway that is less than 70% of the value of $B_0$ for the given passageway, where the distance $L_1$ is at least 1".

16. The game ball of claim 3, where any given passageway defines at least two distinct regions $R_1$ and $R_2$ thereof along the corresponding passageway axis, where the region $R_1$ for the given passageway begins at the plane $P_0$ for the given passageway and extends toward the cavity a distance $L_1$, where the region $R_2$ for the given passageway extends a distance $L_2$ and ends at the cavity, where, over the region $R_1$ of the given passageway, the dimensions $B_n$ for the given passageway do not decrease to less than 90% of the value of $B_0$ for the given passageway, and where, over the region $R_2$ of the given passageway, the dimensions $B_n$ for the given passageway decrease to an amount at the joining aperture for the given passageway that is less than 70% of the value of $B_0$ for the given passageway, where the distance $L_1$ is at least 1".

17. The game ball of claim 2, where any given passageway defines at least two distinct regions $R_1$ and $R_2$ thereof along the corresponding passageway axis, where the region $R_1$ for the given passageway begins at the plane $P_0$ for the given passageway and extends toward the cavity a distance $L_1$, where the region $R_2$ for the given passageway extends a distance $L_2$ and ends at the cavity, where, over the region $R_1$ of the given passageway, the dimensions $B_n$ for the given passageway do not decrease to less than 90% of the value of $B_0$ for the given passageway, and where, over the region $R_2$ of the given passageway, the dimensions $B_n$ for the given passageway decrease to an amount at the joining aperture for the given passageway that is less than 70% of the value of $B_0$ for the given passageway, where the distance $L_1$ is at least 1".

18. The game ball of claim 1, wherein the elongate passageways define corresponding elongate passageway axes and the elongate cavity defines an elongate cavity axis, where any given passageway defines at least two distinct regions $R_1$ and $R_2$ thereof along the corresponding passageway axis, where the region $R_1$ for the given passageway begins at the opening and extends toward the cavity a distance $L_1$, where the region $R_2$ for the given passageway extends a distance $L_2$ and ends at the cavity, where, over the region $R_1$ of the given passageway, the size of the passageway measured perpendicular to the cavity axis does not decrease to less than 90% of its corresponding size at the opening, and where, over the region $R_2$ of the given passageway, the size of the passageway measured perpendicular to the cavity axis decreases no less than 70% of its corresponding size at the opening, where the distance $L_1$ is at least 1".

19. The game ball of claim 18, further comprising a light stick disposed in the elongate cavity.

20. The game ball of claim 17, further comprising a light stick disposed in the elongate cavity.

21. The game ball of claim 16, further comprising a light stick disposed in the elongate cavity.

22. The game ball of claim 15, further comprising a light stick disposed in the elongate cavity.

23. The game ball of claim 14, further comprising a light stick disposed in the elongate cavity.

24. The game ball of claim 13, further comprising a light stick disposed in the elongate cavity.

25. The game ball of claim 12, further comprising a light stick disposed in the elongate cavity.

26. The game ball of claim 11, further comprising a light stick disposed in the elongate cavity.

27. The game ball of claim 10, further comprising a light stick disposed in the elongate cavity.

28. The game ball of claim 9, further comprising a light stick disposed in the elongate cavity.

29. The game ball of claim 8, further comprising a light stick disposed in the elongate cavity.

30. The game ball of claim 7, further comprising a light stick disposed in the elongate cavity.

31. The game ball of claim 6, further comprising a light stick disposed in the elongate cavity.

32. The game ball of claim 5, further comprising a light stick disposed in the elongate cavity.

33. The game ball of claim 4, further comprising a light stick disposed in the elongate cavity.

34. The game ball of claim 3, further comprising a light stick disposed in the elongate cavity.

35. The game ball of claim 2, further comprising a light stick disposed in the elongate cavity.

36. The game ball of claim 1, further comprising a light stick disposed in the elongate cavity.

* * * * *